US009908125B2

(12) United States Patent
Geehan et al.

(10) Patent No.: US 9,908,125 B2
(45) Date of Patent: Mar. 6, 2018

(54) CENTRIFUGE AND CHANGEABLE WEIR INSERTS THEREFOR

(71) Applicant: M-I L.L.C., Houston, TX (US)

(72) Inventors: Thomas Geehan, Houston, TX (US); Leonardo Renzo Vicentini, Berra (IT); Albert Walraven, Dubai (AE)

(73) Assignee: M-1 L.L.C., Houston, TX (US)

( * ) Notice: Subject to any disclaimer, the term of this patent is extended or adjusted under 35 U.S.C. 154(b) by 838 days.

(21) Appl. No.: 14/292,139

(22) Filed: May 30, 2014

(65) Prior Publication Data

US 2014/0274651 A1 Sep. 18, 2014

Related U.S. Application Data

(63) Continuation of application No. 13/058,898, filed as application No. PCT/US2009/052775 on Aug. 5, 2009, now Pat. No. 8,845,506.

(60) Provisional application No. 61/089,358, filed on Aug. 15, 2008.

(51) Int. Cl.

| | |
|---|---|
| ***B04B 11/02*** | (2006.01) |
| ***B04B 11/06*** | (2006.01) |
| ***B04B 1/20*** | (2006.01) |

(52) U.S. Cl.

CPC ..... *B04B 11/06* (2013.01); *B04B 1/20* (2013.01); *B04B 11/02* (2013.01); *B04B 2001/2083* (2013.01); *Y10T 29/49716* (2015.01)

(58) Field of Classification Search

CPC ..... B04B 11/06; B04B 1/20; B04B 11/02; B04B 2001/2083; Y10T 29/49716

USPC ..... 494/53, 54, 56, 57, 60; 210/380.1, 380.3

See application file for complete search history.

(56) References Cited

U.S. PATENT DOCUMENTS

| | | | |
|---|---|---|---|
| 3,580,492 | A | 5/1971 | Schnittger et al. |
| 3,858,794 | A | 1/1975 | Nilson et al. |
| 3,955,756 | A | 5/1976 | Hiller |
| 3,968,929 | A | 7/1976 | Olesen |
| 4,335,846 | A | 6/1982 | Shapiro |
| 4,575,370 | A | 3/1986 | LaMontagne |

(Continued)

FOREIGN PATENT DOCUMENTS

| | | | |
|---|---|---|---|
| DE | 102012014563 | A1 | 1/2014 |
| DE | 102012106226 | A1 | 1/2014 |

(Continued)

OTHER PUBLICATIONS

Extended European Search Report issued in European Patent Application No. 09807079.0; dated Jun. 21, 2016 (8 pages).

(Continued)

*Primary Examiner* — Charles Cooley

(74) *Attorney, Agent, or Firm* — David J. Smith

(57) ABSTRACT

A centrifuge, including: a flange closing off one axial end of a separation chamber; a plurality of apertures that traverse axially through the flange at a radial distance from a flange axis, wherein at least one aperture is in fluid communication with a first outlet passage; a plurality of weir inserts removably disposed within the plurality of apertures to control a flow of one or more fluids from the separation chamber; wherein at least one weir insert disposed within the at least one aperture in fluid communication with the first outlet passage is changeable to prevent or allow fluid communication between the separation chamber and the first outlet passage.

25 Claims, 7 Drawing Sheets

(56) References Cited

U.S. PATENT DOCUMENTS

| | | | | |
|---|---|---|---|---|
| 4,615,690 | A | 10/1986 | Ecker | |
| 4,760,542 | A | 7/1988 | Mehrgardt et al. | |
| 4,764,163 | A | 8/1988 | Caldwell | |
| 4,950,219 | A | 8/1990 | Luchetta | |
| 5,217,428 | A | 6/1993 | Schlip et al. | |
| 5,885,202 | A | 3/1999 | Ostkamp | |
| 6,030,332 | A | 2/2000 | Hensley | |
| 7,115,202 | B2 | 10/2006 | Fleuter et al. | |
| 8,157,716 | B2 * | 4/2012 | Madsen | B04B 1/20 494/53 |
| 8,485,959 | B2 * | 7/2013 | Madsen | B04B 1/20 494/53 |
| 8,579,783 | B2 * | 11/2013 | Krammer | B04B 1/20 494/53 |
| 8,845,506 | B2 * | 9/2014 | Walraven | B04B 1/20 494/53 |
| 8,968,169 | B2 * | 3/2015 | Eiken | B04B 1/20 494/53 |
| 9,028,387 | B2 * | 5/2015 | Eiken | B04B 1/20 494/2 |
| 9,126,208 | B2 * | 9/2015 | Madsen | B04B 1/20 |
| 9,333,514 | B2 * | 5/2016 | Terholsen | B04B 1/20 |
| 9,352,338 | B2 * | 5/2016 | Reiff | B04B 1/20 |
| 9,463,474 | B2 * | 10/2016 | Yoshida | B04B 1/20 |
| 9,579,665 | B2 * | 2/2017 | Madsen | B04B 11/00 |
| 2004/0176234 | A1 | 9/2004 | Leung | |
| 2010/0167901 | A1 * | 7/2010 | Madsen | B04B 1/20 494/60 |
| 2011/0143906 | A1 * | 6/2011 | Geehan | B04B 1/20 494/56 |
| 2012/0021889 | A1 * | 1/2012 | Eiken | B04B 1/20 494/52 |
| 2012/0028782 | A1 * | 2/2012 | Eiken | B04B 1/20 494/2 |
| 2013/0274084 | A1 * | 10/2013 | Madsen | B04B 1/20 494/60 |
| 2013/0310242 | A1 * | 11/2013 | Madsen | B04B 1/20 494/57 |
| 2014/0051565 | A1 * | 2/2014 | Terholsen | B04B 1/20 494/53 |
| 2014/0148326 | A1 * | 5/2014 | Reiff | B04B 1/20 494/56 |
| 2014/0235423 | A1 * | 8/2014 | Pasol | B04B 1/20 494/56 |
| 2014/0274651 | A1 * | 9/2014 | Geehan | B04B 1/20 494/37 |
| 2015/0011372 | A1 * | 1/2015 | Yoshida | B04B 1/20 494/53 |
| 2015/0165449 | A1 * | 6/2015 | Horstkoetter | B04B 1/20 494/53 |
| 2015/0165450 | A1 * | 6/2015 | Schlarb | B04B 1/20 494/53 |
| 2015/0217303 | A1 * | 8/2015 | Bauer | B04B 1/2016 494/4 |
| 2015/0273482 | A1 * | 10/2015 | Bauer | B04B 1/20 494/43 |
| 2015/0360240 | A1 * | 12/2015 | Vielhuber | B04B 1/20 494/24 |

FOREIGN PATENT DOCUMENTS

| | | | |
|---|---|---|---|
| EP | 1588769 | A1 | 10/2005 |
| EP | 2331264 | A2 | 6/2011 |
| EP | 2659985 | A1 | 11/2013 |
| GB | 1569520 | A | 6/1980 |
| JP | 9-239293 | A | 9/1997 |
| JP | 11-090273 | | 4/1999 |
| JP | 11-179236 | | 7/1999 |
| JP | 2002-535139 | A | 10/2002 |

OTHER PUBLICATIONS

International Search Report from PCT/US2009/052775 dated Mar. 15, 2010 (3 pages).

Written Opinion from PCT/US2009/052775 dated Mar. 15, 2010 (3 pages).

International Preliminary Report on Patentability dated Feb. 15, 2011 in International Application No. PCT/US2009/052775 (5 pages).

Examiner's Report dated Mar. 13, 2013 in corresponding Canadian application No. 2,732,622 (3 pages).

Examination Report dated Aug. 1, 2013 in corresponding GCC Patent Office application No. GCC/P/2009/14121 (3 pages).

Second Examiner's Report dated Dec. 30, 2013 in corresponding Canadian application No. 2,732,622 (3 pages).

Notice of Allowance and Fee(s) Due dated Jun. 2, 2014 in related U.S. Appl. No. 13/058,898 (6 pages).

Third Examiner's Report dated Nov. 4, 2014 in corresponding Canadian application No. 2,732,622 (4 pages).

* cited by examiner

CENTRIFUGE AND CHANGEABLE WEIR INSERTS THEREFOR

CROSS-REFERENCE TO RELATED APPLICATIONS

This is a continuation application and claims benefit under 35 U.S.C. §120 of U.S. patent application Ser. No. 13/058,898, filed on Feb. 14, 2011, now U.S. Pat. No. 8,845,506 B2, issued on Sep. 30, 2014, which is the National Stage of the International Application PCT/US2009/052775, filed Aug. 5, 2009, which, pursuant to 35 U.S.C. §119, claims priority to U.S. Provisional Patent Application Ser. No. 61/089,358, filed Aug. 15, 2008. All of these applications are incorporated by reference in their entirety

BACKGROUND OF DISCLOSURE

Field of the Disclosure

Embodiments disclosed herein relate generally to centrifuges for the separation of a suspension with one or more liquid phases of different specific gravities. In another aspect, embodiments disclosed herein relate to centrifuges convertible between two-phase and three-phase operations. In a more specific aspect, embodiments disclosed herein relate to centrifuges convertible between two-phase and three-plunge operations via use of a changeable weir insert, where the conversion may be performed without dismantling the centrifuge.

Background

Centrifuges are often used to effect separation of liquid-solid mixtures. For example, well drill cuttings, drilling mud, slop oil, and other wastes generated during drilling of wells and general chemical processing may be separated using a centrifuge. Such mixtures may include solids and one or more of oleaginous fluids and aqueous fluids.

When used to separate three-phase mixtures, such as an oil/water/solids mixture, typical centrifuges allow for the separation of the solid from the fluids, i.e., two-phase separations. The fluids are subsequently separated using additional equipment. Other centrifuges are specifically designed for three-phase separation, allowing for separate recovery of the oil and the water phases.

The liquid-solid mixtures encountered for a given process or for a desired use of a centrifuge may vary, and may include two-phase mixtures, three-phase mixtures, and the oil to water ratio may additionally vary from low, mostly water, to high, mostly oil. Centrifuges that may be configured to allow for separation of either two-phase or three-phase mixtures are described in, for example, GB 1569520A and U.S. Pat. No. 4,615,690 ('the '690 patent). Additionally, mention of centrifuge modification to transform a centrifuge from three-phase operation to two-phase operation is mentioned in EP 181953 A1.

GB 1569520A describes a centrifuge apparatus allowing for conversion between two-phase operation and three-phase operation. For two-phase operation where only one liquid phase is to be removed, all the openings to the receiving chamber which houses the skimmer mechanism are opened, while the radially-directed outlet openings are closed. A weir-barrier has been removed so that only the skimmer mechanism operates and draws off the liquid phase. For three-phase operation, i.e., if two liquid phases of different specific gravity must be removed separately, a portion of the openings are closed at their ends away from the separation chamber in the axial direction, and the outlet passages for these openings are opened. The weir-barrier is installed in such a way that the openings (connected as before with the receiving chamber which houses the skimmer mechanism) are connected with the separation chamber in a radially outward region, thus collecting the liquid phase of higher specific gravity while the other openings, with the aid of the weir-barrier, are connected with the separation chamber in an inner radial region, and thus collect the liquid phase of lower specific gravity, which is then conducted through associated outlet passages into a collector.

Similarly, U.S. Pat. No. 4,615,690 ('690) discloses a centrifuge apparatus allowing for conversion between two-phase and three-phase operation, where FIG. 1 illustrates such a centrifuge (a reproduction of FIG. 1 of the '690 patent). If all the openings 4 remain open to the receiving chamber 5, the decanter is in two-phase operation, i.e., the suspension introduced into the separation chamber 2 is separated into a solid phase and liquid phase, the whole of the latter of which is withdrawn through the skimmer mechanism 7, as described in greater detail in GB 1569520A. In three-phase operations, i.e., separation of a suspension into a solid phase, to be carried out by the screw conveyer, not shown, and two liquid phases of different specific gravities, indicated in FIG. 1 by the different liquid levels in the separation chamber, with the heavier liquid phase occupying the radially outward space of the pool, the two liquid phases are to be drawn off separately. The respective levels of the two liquid phases are determined by the skimmer disks or weirs 11. A first subset of the openings 4 are closed at their ends toward the separation chamber by covers 10, and thus separated from the receiving chamber 5, while the remaining subset of the openings 4 are opened at that same end, and thus communicate with the receiving chamber 5.

Varying such centrifuges from two-phase operation to three-phase operation can be cumbersome and time consuming. For example, it may be required to remove the entire cover flange, shaft, and other portions of the centrifuge to effect the change from two-phase to three-phase operations. Such operations may require transport of the centrifuge, or at least a portion thereof, to a machine shop for change of the operating configuration in a controlled environment.

U.S. Pat. No. 3,968,929 discloses a centrifuge in which the liquid level in the centrifuge may be controlled by replacing inserts without dismantling of additional components of the centrifuge. No teaching is provided with respect to conversion between two and three phase operations, and skimmers and other components necessary for three-phase operation are each internal to the centrifuge.

Other patents disclosing use of weir discs, each internal to the centrifuge, include U.S. Pat. Nos. 3,955,756, 5,885,202, 6,030,332, and 7,115,202, among others.

Accordingly, there exists a need for centrifuges that are easily converted from two-phase to three-phase operation and vice versa.

SUMMARY OF THE DISCLOSURE

In one aspect, embodiments disclosed herein relate to a centrifuge, including: a flange closing off one axial end of a separation chamber; a plurality of apertures that traverse axially through the flange at a radial distance from a flange axis, wherein at least one aperture is in fluid communication with a first outlet passage; a plurality of weir inserts removably disposed within the plurality of apertures to control a flow of one or more fluids from the separation chamber; wherein at least one weir insert disposed within the at least one aperture in fluid communication with the first outlet passage is changeable to prevent or allow fluid communication between the separation chamber and the first outlet passage.

In another aspect, embodiments disclosed herein relate to a centrifuge, including: a flange closing off one axial end of a separation chamber; a plurality of apertures that traverse axially through the flange at a radial distance from a flange axis, wherein at least one aperture is in fluid communication with a first outlet passage; a plurality of weir inserts removably disposed within the plurality of apertures to control a flow of one or more fluids from the separation chamber; wherein, when in a first position, a weir insert disposed within the at least one aperture in fluid communication with the first outlet passage provides for fluid communication between the separation chamber and the first outlet passage; and wherein, when in a second position, the weir insert disposed within the at least one aperture in fluid communication with the first outlet passage blocks fluid communication between the separation chamber the first outlet passage.

In another aspect, embodiments disclosed herein relate to a method for converting a centrifuge between two-phase and three-phase operations, wherein the centrifuge includes: a flange closing off one axial end of a separation chamber; a plurality of apertures that traverse axially through the flange at a radial distance from a flange axis, wherein at least one aperture is in fluid communication with a first outlet passage; a plurality of weir inserts removably disposed within the plurality of apertures to control a flow of one or more fluids from the separation chamber; the method including: changing the at least one weir insert disposed within the at least one opening in fluid communication with the first outlet passage to prevent or allow fluid communication between the separation chamber and the first outlet passage.

In another aspect, embodiments disclosed herein relate to a weir insert for use in a centrifuge, including: a frame comprising: an outer portion; an inner portion; a first fluid passage fluidly connecting the inner portion and the outer portion; and a second fluid passage fluidly connected and transverse to the first fluid passage; an inner weir disposed on the inner portion for control of a fluid flow from the separation chamber into the first fluid passage; and an outer weir disposed on the outer portion for control of a fluid flow from the first fluid passage through at least one of the outer portion and the second fluid passage.

Other aspects and advantages will be apparent from the following description and the appended claims.

DETAILED DESCRIPTION

Figure 1:
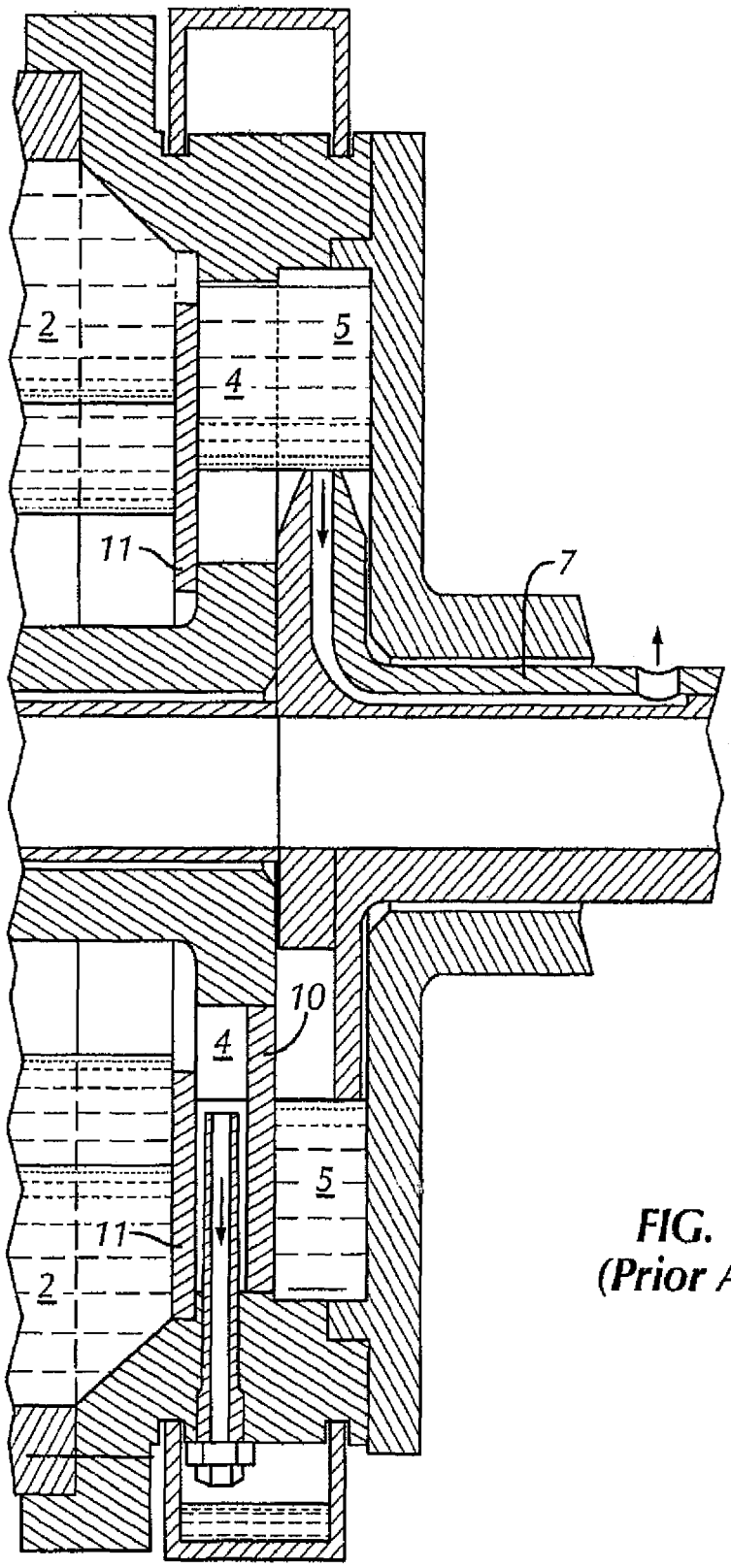
FIG. 1 (Prior Art)
FIG. 1 is a schematic diagram of a prior art centrifuge.

In one aspect, embodiments disclosed herein relate to centrifuges for the separation of a suspension with one or more liquid phases of different specific gravities. In another aspect, embodiments disclosed herein relate to centrifuges convertible between two-phase and three-phase operations. In a more specific aspect, embodiments disclosed herein relate to centrifuges convertible between two-phase and three-phase operations via use of a changeable weir insert, where the conversion may be performed without dismantling the centrifuge. "Changeable," as used herein, refers to the ability to alter a position of at least a portion of the weir insert, the ability to interchange at least one component of the weir insert, or the ability to interchange a weir insert with another weir insert to effect the desired conversion from two-phase to three-phase operations.

Centrifuges according to embodiments disclosed herein have an outer drum and an internal rotor carrying a conveyor screw, as well as bearing means for the drum and the rotor. During operation of the centrifuge, a raw material, which contains one or more liquid phases and a solid phase, is supplied to the separation chamber, defined between the drum and the rotor, and when the latter rotates at an angular velocity different from that of the drum, the screw conveyor will displace the solid material that, due to the centrifugal force, is pressed against the wall of the drum, towards an outlet aperture at one end of the drum, while the liquid phase is discharged through one or more apertures at the opposite end of the drum, where the apertures may be located in a flange closing off the end of the separation chamber. The apertures may traverse axially through the flange a radial distance from the flange axis, where one or more of the apertures may be in fluid communication with an outlet passage. In some embodiments, the outlet passage may extend radially from the aperture to an inner or outer periphery of the flange.

Weir inserts may be removably disposed within the apertures to control a level of the one or more liquid phases within the separation chamber and to direct flow of the one or more liquid phases to a desired collection point. The weir inserts are accessible without dismantling the centrifuge, thus allowing an operator to change one or more of the weir inserts to provide the desired liquid level and/or flow scheme (e.g., two-phase or three-phase separations). For example, in some embodiments, an inner portion of the weir insert in fluid contact with the separation chamber may be changeable so as to alter liquid levels (e.g., provide a higher or lower weir) or to prevent fluid communication through the aperture, including prevention of one or both fluid phases. In other embodiments, a frame portion of the weir insert may be rotatable to allow or prevent fluid communication with the radial outlet passage. In yet other embodiments, an outer portion of the weir insert may be changeable from a weir disk to a blind disk so as to direct flow to the desired collection point. Examples of such embodiments are described below in relation to FIGS. 2-9.

Figure 2:
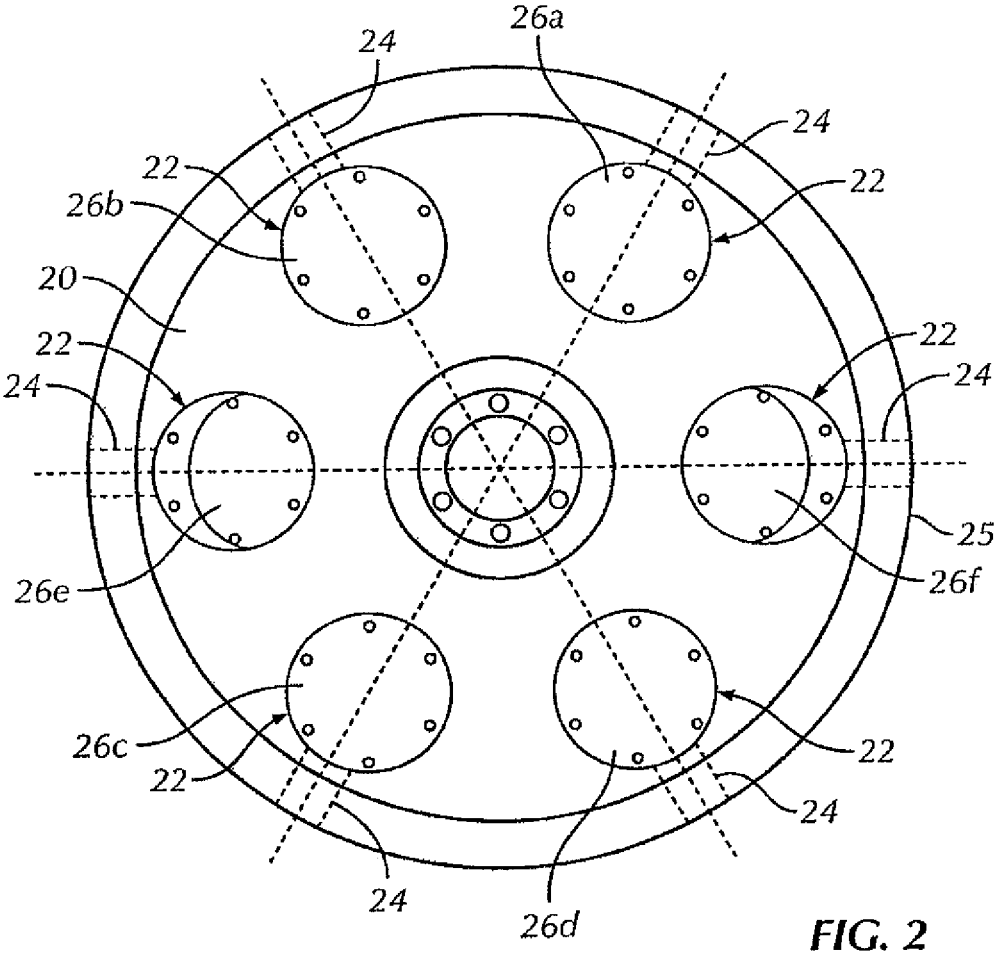
FIG. 2 is an end view of a centrifuge including weir inserts for rapid conversion between two-phase and three-phase operations according to embodiments disclosed herein.

One example of a centrifuge having weir inserts according to embodiments disclosed herein is illustrated in FIG. 2. A flange 20 closing off one end of a centrifuge separation chamber (not illustrated) has one or more apertures 22 distributed radially through the flange 20. As illustrated, flange 20 includes 6 apertures 22, where each has a corresponding aperture located 180° apart, as typically used for balancing of the centrifuge. Greater or fewer apertures 22 may be used in various embodiments. Additionally, one or more of the apertures may be in fluid communication with a radial outlet passage 24, extending from apertures 22 to an outer periphery 25 of flange 20.

Removably disposed in each aperture 22 is a weir insert 26 (26*a*, 26*b*, 26*c*, 26*d*, 26*e*, and 26*f*). As illustrated in FIG.

2, the weir inserts 26 are selected such that the centrifuge is operating in a three-phase separation mode. Weir inserts 26*a-d* direct fluid flow from the separation chamber through the respective radial outlet passages 24 to a first collection zone (not illustrated), whereas weir inserts 26*e-f* restrict fluid flow to the respective radial outlet passages 24, allowing the fluid to pass through the weir insert to a second collection zone (not illustrated).

Figure 3:
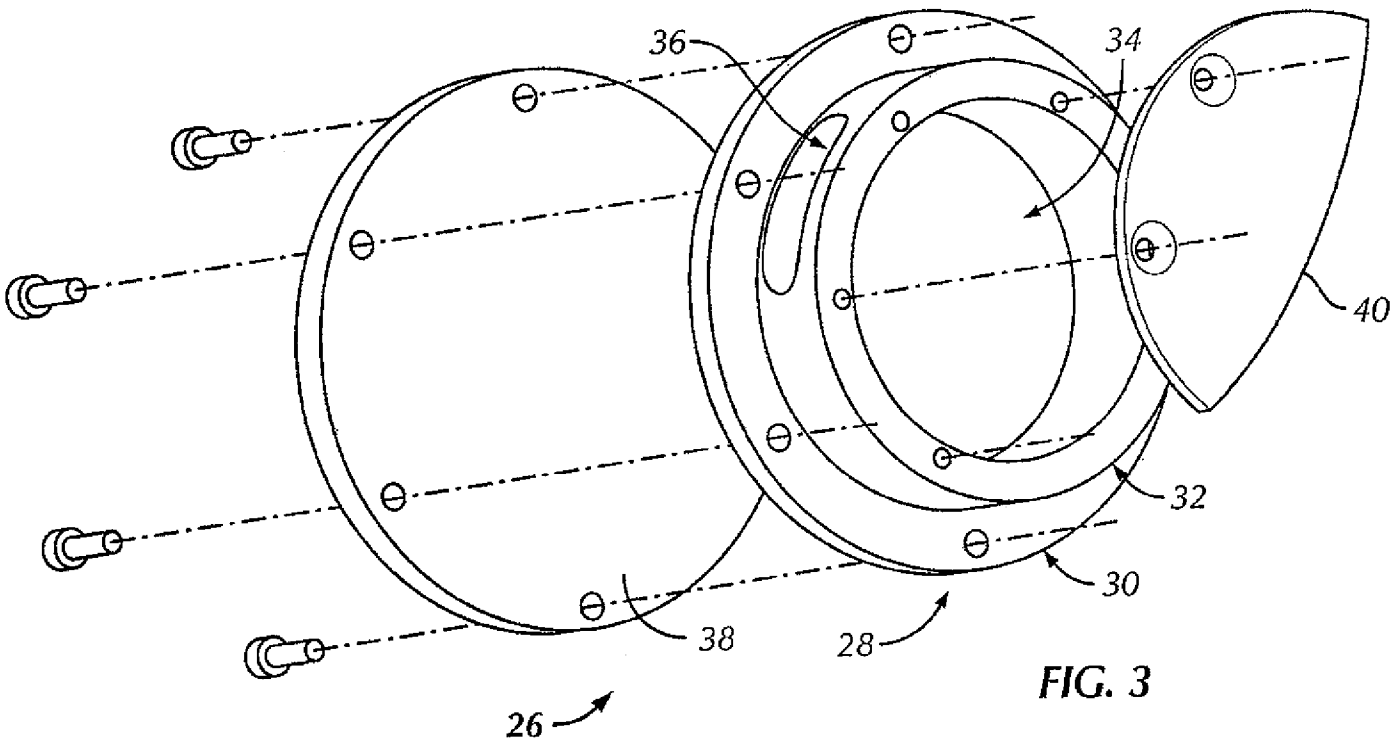
FIG. 3 illustrates a weir insert according to embodiments disclosed herein.

One example of a weir insert 26 is illustrated in FIG. 3. The weir insert 26 may include a frame portion 28 having an outer portion 30, an inner portion 32, and a first fluid passage 34 fluidly connecting outer portion 30 and inner portion 32. Frame portion 28 may also include a second fluid passage 36 fluidly connected and transverse to first fluid passage 34.

An outer weir 38 may be disposed or removably disposed on outer portion 30, and an inner weir 40 may be disposed or removably disposed on inner portion 32. Each of outer weir 38 and inner weir 40 may be used to control one or more of a) a level of a liquid phase being separated and b) fluid flow through first fluid passage 34 and second fluid passage 36. For example, inner weir 40 and outer weir 38 may include one or more of a blind disk and a weir disk.

Figure 4:
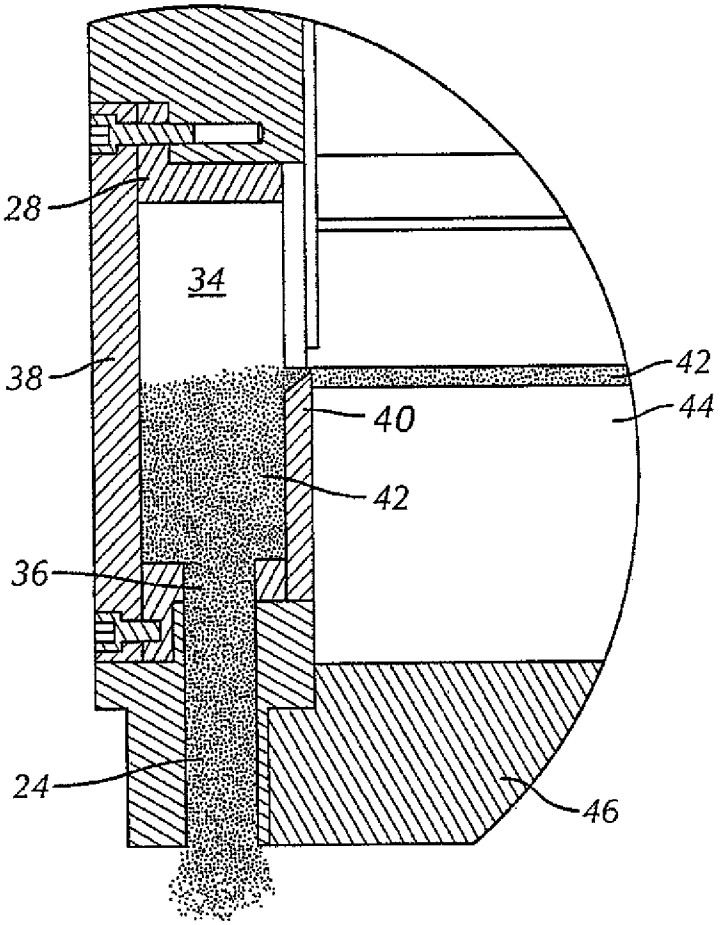
FIG. 4 is a schematic diagram of a portion of a centrifuge including weir inserts according to embodiments disclosed herein.

Referring now to FIGS. 3 and 4, where like numerals represent like parts, the manner in which the inner weir 40 and outer weir 38 may be used to control fluid level and flow is illustrated. Three-phase centrifuge separations may result in a light phase 42, such as an oil phase, and a heavy phase 44, such as an aqueous phase, accumulating in separation chamber 46. Inner weir 40 is of sufficient height and is positioned so as to restrict a flow of heavy phase 44, while allowing a flow of light phase 42 into first fluid passage 34. Outer weir 38, as illustrated, is a blind disk. As a result, the light phase 42 fluid flowing from separation chamber 46 over inner weir 40 and into the first fluid passage 34 will be directed through second fluid passage 36 which is in fluid communication with radial outlet passage 24.

Figure 5:
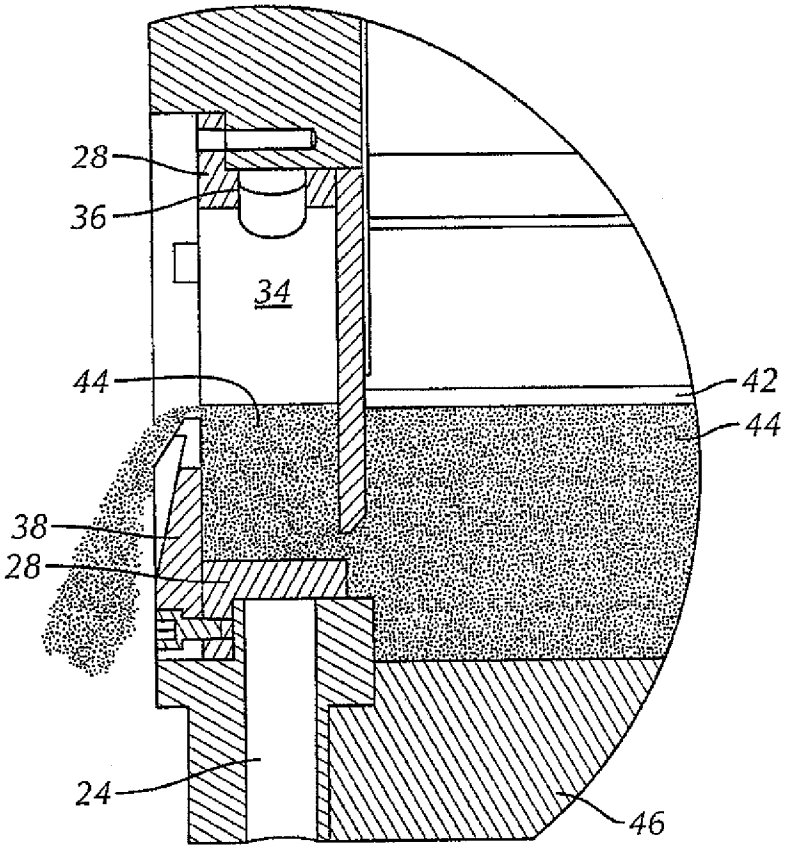
FIG. 5 is a schematic diagram of a portion of a centrifuge including weir inserts according to embodiments disclosed herein.

The heavy phase 44 fluid level and flow may be controlled using a weir insert as illustrated in FIG. 5, where like numerals represent like parts. Inner weir 40 is of sufficient height and is positioned so as to restrict a flow of light phase 42, while allowing a flow of heavy phase 44 into first fluid passage 34. In this embodiment, frame portion 28 is rotated such that second fluid passage 36 is not in fluid communication with radial outlet passage 24. Outer weir 38, as illustrated, is a weir having a desired height so as to maintain the desired level of heavy phase 44 within separation chamber 46. As a result, the heavy phase 44 flowing from separation chamber 46 over outer weir 38 may be collected separately from the light phase 42 when weir inserts as illustrated in FIGS. 4 and 5 are used collectively, thus providing for three-phase separations.

As mentioned above, the frame portion 28 of weir inserts 26 may be rotated so as to restrict fluid communication between first fluid passage 34 and radial outlet passage 24. Although rotation of frame portion 28 by less than 180° may restrict fluid flow, centrifuge balance typically requires that the frame portion 28 be rotated 180°.

Figure 6:
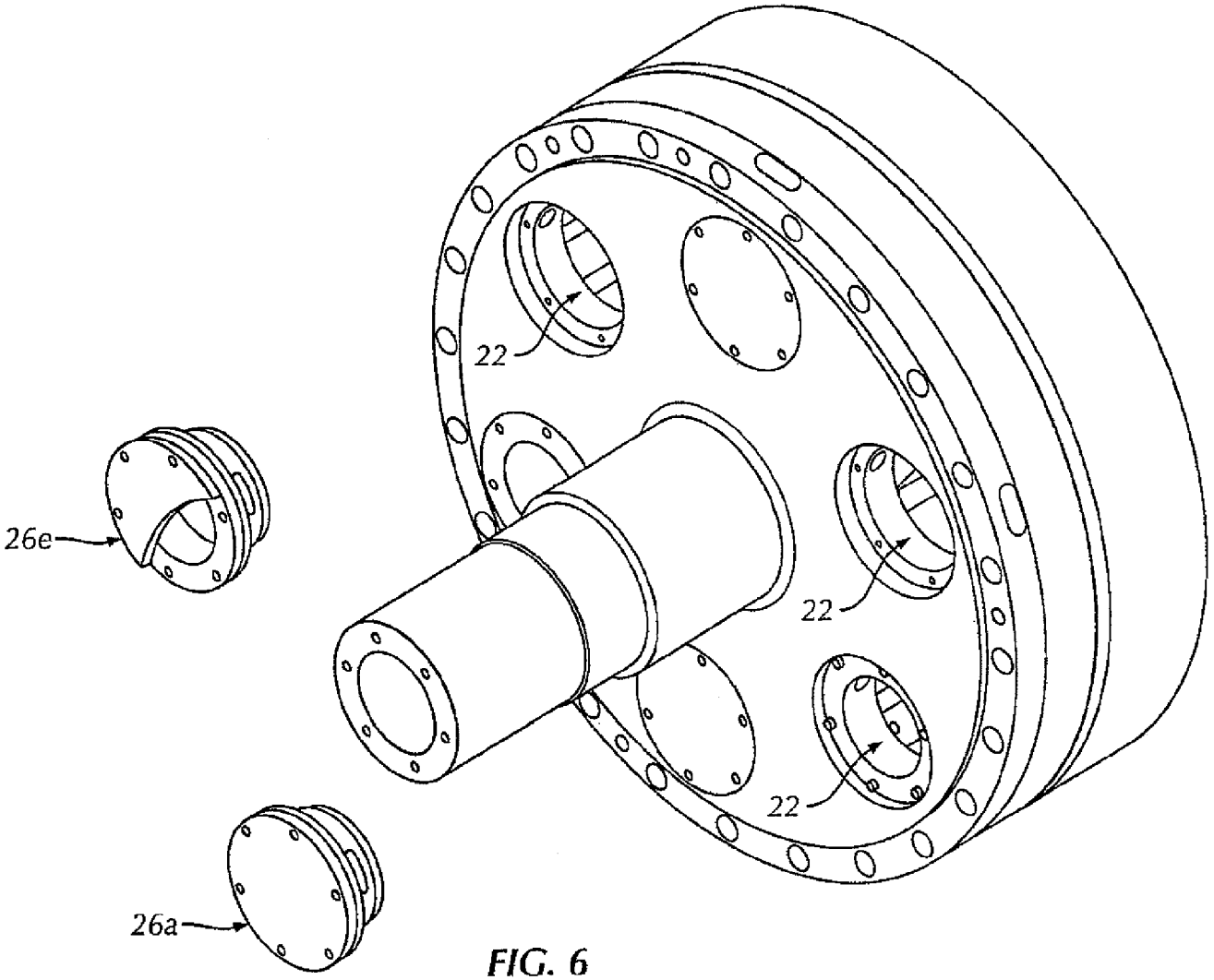
FIGS. 6-9 are perspective views illustrating interchange of weir inserts according to embodiments disclosed herein.
Figure 7:
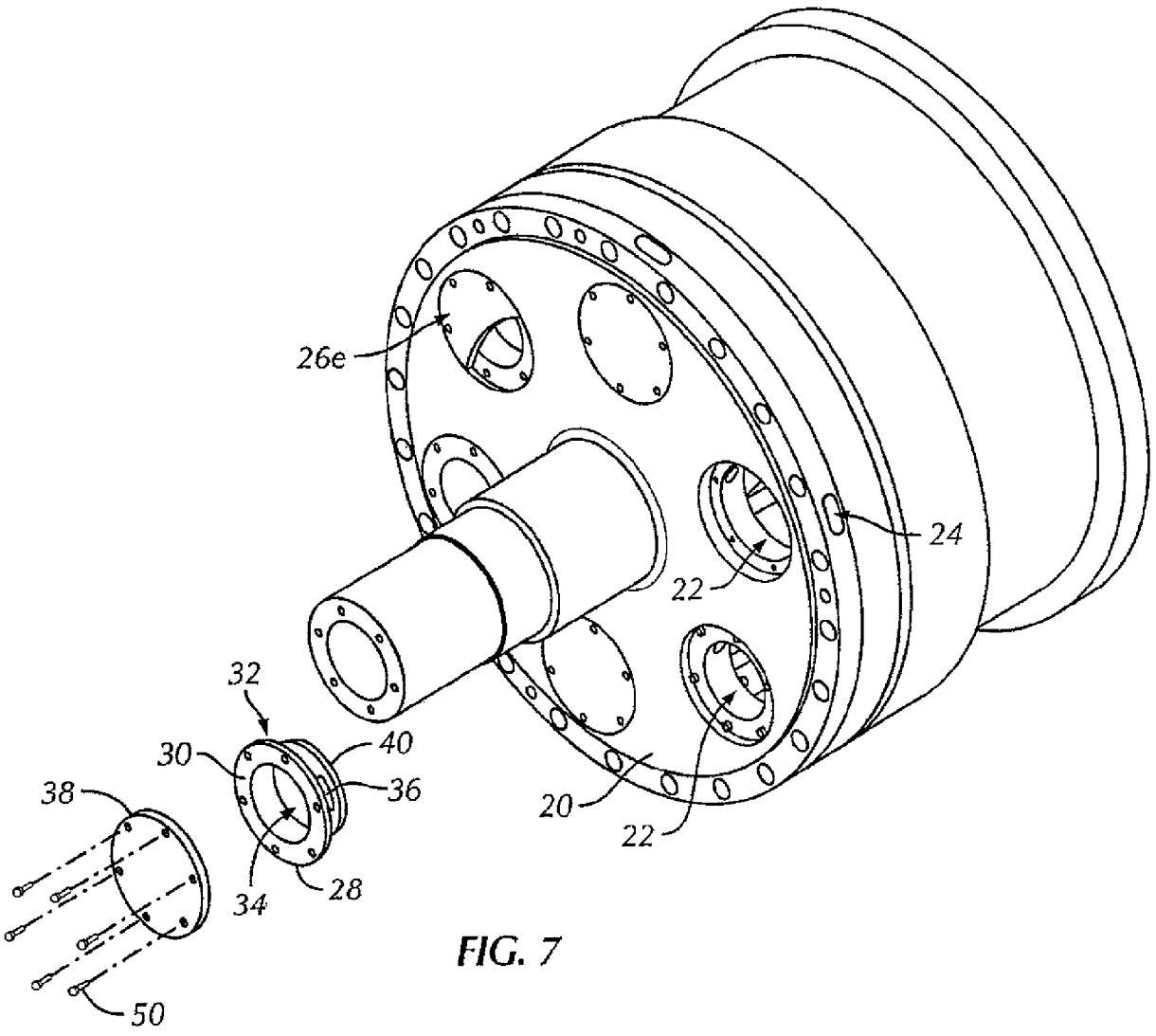
Figure 8:
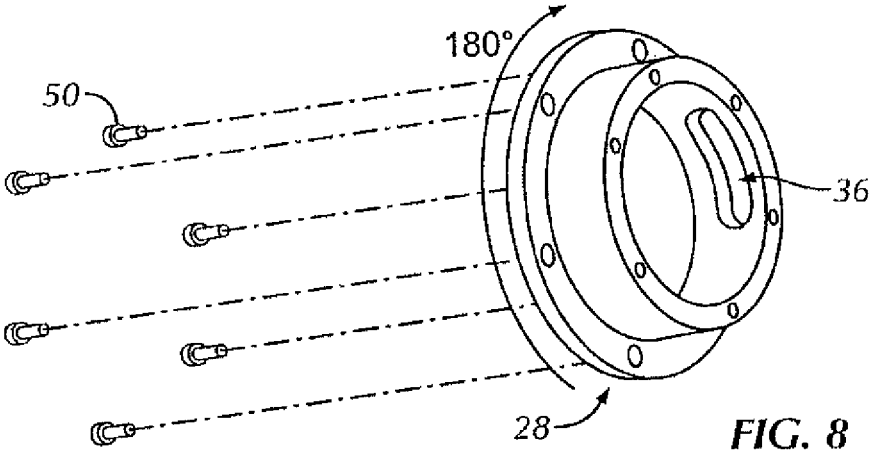
Figure 9:
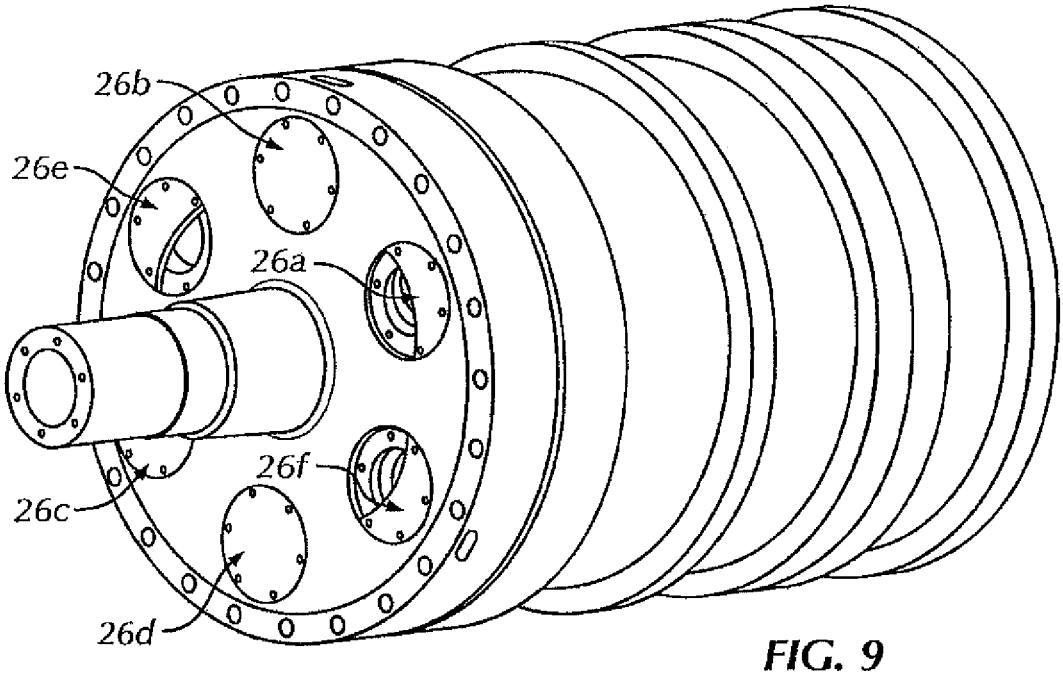

The weir inserts, as mentioned above, are changeable to allow for conversion of the centrifuge from two-phase to three-phase operations. Referring now to FIGS. 2 and 6-9, where like numerals represent like parts, a method for converting centrifuges between two-phase and three-phase operations according to embodiments is illustrated, where the weir inserts include inner and outer weirs removably disposed on the frame portion. As illustrated in FIG. 2, a centrifuge may include two heavy phase weir inserts 26*e-f* and four light phase weir inserts 26*a-d*. Referring now to FIGS. 6 and 7, a light phase weir insert, such as weir insert 26*a*, may be removed from aperture 22, such as via bolts 50 or other devices for removably connecting the weir inserts 26 to flange 20. Outer weir 38, a blind disk, and inner weir 40 may also be removed from frame portion 28. Outer weir 38 and inner weir 40 may then be configured to have the desired flow characteristics. The outer weir 38 and inner weir 40 are installed such that, upon re-installation of the weir insert 26*a* in aperture 22, that the second fluid passage 36 is rotated 180°, as illustrated in FIG. 8, to prevent fluid communication between first fluid passage 34 and radial outlet passage 24. Such a process results in weir insert 26*a* having the same flow characteristics of weir inserts 26*e-f*, as illustrated in FIG. 9. Likewise, weir inserts 26*b-d* may be removed, changed, and re-installed such that each weir insert 26 has the same flow and liquid level control characteristics, thus resulting in a centrifuge suitable for two-phase separations (liquid-solid).

To change from two-phase separation mode to three phase separation mode, a similar procedure would be used to change inner weir 40 and outer weir 38 and to realign second fluid passage 36 with radial outlet passage 24.

Conversion of the centrifuge is likewise performed where the inner and outer weirs are not removably disposed on the frame portion. For example, a weir insert configured for light phase fluid recovery via a radial outlet passage may be interchanged with a weir insert configured for single-phase fluid recovery. Likewise, multi-piece inserts may be pre-assembled and interchanged to result in the desired centrifuge configuration. Thus, single or multi-piece weir inserts may be interchanged according to embodiments disclosed herein to result in the desired separations.

In other embodiments, a weir insert 26 having a frame portion 28 without a second fluid passage 36 may be used when collecting a heavy phase or a single phase via first fluid passage 34 only. Considering centrifuge balance, it is preferred to use weir inserts having a similarly designed frame portions 28 at positions 180° apart on flange 20. Additionally, light phase and heavy phase collections should be performed in pairs, similar to that as illustrated in FIG. 2, with weir inserts located 180° apart collect the same fluid phase.

Single piece weir inserts, multi-piece weir inserts, or portions of multi-piece weir inserts may also be interchanged so as to obtain the desired level for a single phase fluid recovery, or the desired light and heavy phase fluid levels when separating two liquid phases. For example, the height of the outer weirs and/or inner weirs may be changed so as to result in the desired separation and/or improve the separation efficiency. For example, referring to FIG. 3, inner weir 40 may be changed so as to adjust the level of the light phase in the separation chamber 46. Likewise, referring to FIG. 4, outer weir 38 may be changed to adjust a level of the heavy phase in the separation chamber.

Weir inserts illustrated in FIGS. 2-9 are illustrated as cylindrical. Weir inserts having other shapes are possible; however, balance of the centrifuge must be considered when designing the weir inserts.

As described above, centrifuges according to embodiments disclosed herein may include a plurality of weir inserts providing for rapid conversion of a centrifuge between two-phase and three-phase operations via interchange of weir insert or weir insert components. Advantageously, embodiments disclosed herein may allow for the conversion of centrifuge operations to be performed without the need to dismantle the centrifuge, such as by removal of flange 20 from separation chamber 46. As such, conversion of centrifuge operations may be performed rapidly, minimizing down time. Additionally, interchange of weir inserts or weir insert components may allow for variation of liquid levels so as to easily adapt the centrifuge for efficient performance of the desired separations.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A centrifuge, comprising:

a flange closing off one axial end of a separation chamber;

a plurality of apertures that traverse axially through the flange at a radial distance from a flange axis, wherein at least one aperture is in fluid communication with a first outlet passage; and a plurality of weir inserts removably disposed within the plurality of apertures to control a flow of one or more fluids from the separation chamber, wherein at least one weir insert disposed within the at least one aperture in fluid communication with the first outlet passage is configured to perform at least one of 1) both prevent and allow fluid communication between the separation chamber and the first outlet passage and 2) change the centrifuge operation from two-phase to three-phase; and wherein the at least one changeable weir insert comprises:

a frame comprising:

an outer portion;

an inner portion located adjacent to the separation chamber and having a perimeter defined by an exterior wall having a height defined by a first end of the exterior wall located adjacent to the separation chamber and a second opposite end of the exterior wall located adjacent to the outer portion;

a first fluid passage fluidly connecting the inner portion and the outer portion and in fluid communication with the separation chamber when the at least one weir insert is configured to allow fluid communication between the separation chamber and the first outlet passage such that the first fluid passage of the frame of the at least one changeable weir insert fluidly connects the separation chamber and the first outlet passage; and a second fluid passage fluidly connected and transverse to the first fluid passage, wherein the second fluid passage extends through the perimeter of the inner portion defined by the exterior wall of the inner portion and along the height of the exterior wall between the first and second ends of the exterior wall.

2. The centrifuge of claim 1, wherein the first outlet passage extends radially from the at least one aperture to an outer periphery of the flange.

3. The centrifuge of claim 1, wherein the at least one changeable weir insert further comprises:

an inner weir disposed on the inner portion for control of a fluid flow from the separation chamber into the first fluid passage; and an outer weir disposed on the outer portion for control of a fluid flow from the first fluid passage through at least one of the outer portion and the second fluid passage.

4. The centrifuge of claim 3, wherein the frame is cylindrical.

5. The centrifuge of claim 3, wherein a rotation of the at least one changeable weir insert prevents fluid communication between the separation chamber and the first outlet passage.

6. The centrifuge of claim 3, wherein the outer weir comprises at least one of a blind disk and a weir disk.

7. The centrifuge of claim 3, wherein the inner weir is removably disposed on the inner portion.

8. The centrifuge of claim 3, wherein the outer weir is removably disposed on the outer portion.

9. The centrifuge of claim 3, wherein the inner weir comprises at least one of a blind disk and a weir disk.

10. A centrifuge, comprising:

a flange closing off one axial end of a separation chamber;

a plurality of apertures that traverse axially through the flange at a radial distance from a flange axis, wherein at least one aperture is in fluid communication with a first outlet passage; and a plurality of weir inserts removably disposed within the plurality of apertures to control a flow of one or more fluids from the separation chamber, wherein, when in a first position, a weir insert disposed within the at least one aperture in fluid communication with the first outlet passage provides for fluid communication between the separation chamber and the first outlet passage;

wherein, when in a second position, the weir insert disposed within the at least one aperture in fluid communication with the first outlet passage blocks fluid communication between the separation chamber and the first outlet passage, wherein the weir insert disposed within the at least one aperture in fluid communication with the first outlet passage, in the first position or the second position, is changeable to allow the centrifuge to operate in two-phase or three-phase, wherein the weir insert disposed within the at least one aperture comprises:

a frame comprising:

an outer portion; and an inner portion comprising a first fluid passage, fluidly connecting the inner portion and the outer portion, and a second fluid passage fluidly connected and transverse to the first fluid passage, and wherein, when the weir insert disposed within the at least one aperture is located in the second position, a wall of the inner portion located opposite with respect to the second fluid passage blocks the fluid communication between the separation chamber and the first outlet passage.

11. The centrifuge of claim 10, wherein the first outlet passage extends radially from the at least one aperture to an outer periphery of the flange.

12. The centrifuge of claim 10, wherein the weir insert further comprises:

an inner weir disposed on the inner portion for control of a fluid flow from the separation chamber into the first fluid passage; and an outer weir disposed on the outer portion for control of a fluid flow from the first fluid passage through at least one of the outer portion and the second fluid passage.

13. The centrifuge of claim 12, wherein the frame is cylindrical.

14. The centrifuge of claim 12, wherein the outer weir comprises at least one of a blind disk and a weir disk.

15. The centrifuge of claim 12, wherein the inner weir comprises at least one of a blind disk and a weir disk.

16. The centrifuge of claim 12, wherein the inner weir is removably disposed on the inner portion.

17. The centrifuge of claim 12, wherein the outer weir is removably disposed on the outer portion.

18. A method for converting a centrifuge between two-phase and three-phase operations, wherein the centrifuge comprises:

a flange closing off one axial end of a separation chamber;

a plurality of apertures that traverse axially through the flange at a radial distance from a flange axis, wherein at least one aperture is in fluid communication with a first outlet passage;

a plurality of weir inserts removably disposed within the plurality of apertures to control a flow of one or more fluids from the separation chamber; and at least one weir insert disposed within the at least one aperture in fluid communication with the first outlet passage, wherein the at least one weir insert comprises:

a frame comprising:

an outer portion;

an inner portion located proximate with respect to the separation chamber; and a first fluid passage fluidly connecting the inner portion and the outer portion and fluidly connectible to at least one selected from the separation chamber and the first outlet passage, the method comprising:

changing the at least one weir insert disposed within the at least one aperture in fluid communication with the first outlet passage to both prevent and allow fluid communication between the separation chamber and the first outlet passage, wherein, when the at least one weir is changed to allow the fluid communication between the separation chamber and the first outlet passage, the first fluid passage of the frame of the at least one weir insert provides the fluid communication between the separation chamber and the first outlet passage.

19. The method of claim 18, wherein the changing comprises rotating the at least one weir insert disposed within the at least one aperture in fluid communication with the first outlet passage.

20. The method of claim 18, wherein the changing comprises interchanging a weir insert providing fluid communication between the separation chamber and the first outlet passage and a weir insert preventing fluid communication between the separation chamber and the first outlet passage.

21. The method of claim 18, wherein the at least one changeable weir insert further comprises:

a second fluid passage of the frame fluidly connected and transverse to the first fluid passage;

an inner weir disposed on the inner portion for control of a fluid flow from the separation chamber into the first fluid passage; and an outer weir disposed on the outer portion for control of a fluid flow from the first fluid passage through at least one of the outer portion and the second fluid passage.

22. The method of claim 21, the changing comprising at least one of:

varying the inner weir;

varying the outer weir;

varying the frame; and rotating the frame.

23. The method of claim 22, wherein the varying the outer weir comprises interchanging a blind disk and a weir disk.

24. The method of claim 22, wherein the varying the inner weir comprises interchanging a blind disk and a weir disk.

25. The method of claim 22, wherein varying the frame comprises interchanging a frame comprising a second fluid passage for a frame absent a second fluid passage.

* * * * *